United States Patent [19]

DePriester

[11] 4,335,980

[45] Jun. 22, 1982

[54] HULL HEATING SYSTEM FOR AN ARCTIC OFFSHORE PRODUCTION STRUCTURE

[75] Inventor: Coral L. DePriester, Moraga, Calif.

[73] Assignee: Chevron Research Company, San Francisco, Calif.

[21] Appl. No.: 144,715

[22] Filed: Apr. 28, 1980

[51] Int. Cl.[3] ..... E02D 21/00

[52] U.S. Cl. ..... 405/217; 405/61

[58] Field of Search ..... 405/211, 217, 60, 61, 405/195–208, 224–227

[56] References Cited

U.S. PATENT DOCUMENTS

| | | | |
|---|---|---|---|
| 3,749,162 | 7/1973 | Anders | 405/217 X |
| 3,831,385 | 8/1974 | Hudson et al. . | |
| 3,972,199 | 8/1976 | Hudson et al. | 405/217 |
| 3,972,199 | 8/1976 | Hudson et al. . | |
| 4,073,144 | 2/1978 | Lea | 405/217 X |
| 4,075,964 | 2/1978 | Sjogren | 114/40 |
| 4,102,144 | 7/1978 | Anders | 405/217 X |
| 4,117,794 | 10/1978 | Sjogren | 405/217 X |
| 4,260,292 | 4/1981 | Steddum et al. | 405/217 |

FOREIGN PATENT DOCUMENTS

| | | | |
|---|---|---|---|
| 996765 | 9/1976 | Canada | 405/217 |

*Primary Examiner*—Dennis L. Taylor

*Attorney, Agent, or Firm*—J. A. Buchanan, Jr.; R. H. Evans

[57] ABSTRACT

A hull heating system for an offshore production structure for use in arctic waters wherein the heat from the produced fluids is used to maintain the temperature of the outer surface of the structure above the melting temperature of the ice adjacent the structure.

13 Claims, 8 Drawing Figures

HULL HEATING SYSTEM FOR AN ARCTIC OFFSHORE PRODUCTION STRUCTURE

FIELD OF THE INVENTION

The present invention relates to offshore structures that are to be used in waters which contain ice masses, and more particularly, to a hull heating system for an offshore production structure located in waters which become frozen through natural conditions.

BACKGROUND OF THE INVENTION

In recent years, offshore exploration for and production of petroleum products has been extended into arctic and other ice-infested waters in such locations as northern Alaska and Canada. These waters are generally covered with vast areas of sheet ice 9 months or more out of the year. Sheet ice may reach a thickness of 5 to 10 feet or more, and may have a compressive or crushing strength in the range of about 200 to 1000 pounds per square inch. Although appearing stationary, ice sheets actually move laterally with wind and water currents and thus can impose very high forces on any stationary structure in their paths.

A still more severe problem encountered in arctic waters is the presence of larger masses of ice such as pressure ridges, rafted ice or floebergs. Pressure ridges are formed when two separate sheets of ice move toward each other and collide. Pressure ridges can be very large, with lengths of hundreds of feet, widths of more than a hundred feet, and a thickness of up to 50 feet. Consequently, pressure ridges can exert a proportionally greater force on an offshore structure than ordinary sheet ice. Thus, the possibility of pressure ridges causing extensive damage to an offshore structure or the catastrophic failure of a structure is very great.

It has been proposed heretofore that rather than build a structure strong enough to withstand the total crushing force of the ice, that is, strong enough to permit the ice to be crushed against the structure, the structure be built with a ramp-like surface. As the ice comes into contact with such a surface, it is forced upwardly above its normal position, causing the ice to fail in flexure by placing a tensile stress in the ice. Since the ice has a flexural strength of about 85 pounds per square inch, a correspondingly smaller force is placed on the structure as the ice impinging thereon fails in flexure rather than in compression.

Several forms of structures having a sloping peripheral wall are illustrated in a paper by J. V. Danys entitled "Effect of Cone-Shaped Structures on Impact Forces of Ice Floes," presented to the First International Conference on Port and Ocean Engineering under Arctic Conditions held at the Technical University of Norway, Trondheim, Norway, during August 13 to 30, 1971. Another publication of interest in this respect is a paper by Ben C. Gerwick, Jr. and Ronald R. Lloyd entitled "Design and Construction Procedures for Proposed Arctic Offshore Structures," presented at the Offshore Technology Conference meeting at Houston, Texas during April 1970.

In the far northern artic waters, such as the waters off the north slope of Alaska, the open water season is relatively short, approximately six weeks. After the end of the season, ice begins to form on the open waters where it will freeze around and onto any structure established in the water. This condition has been duplicated in the laboratory to determine what effect the new sheet ice would have on a scale model of a structure having a ramp-like surface and particularly to determine what forces would be imposed on such a structure.

As the ice sheet built up in thickness on the surface of the water surrounding the model structure, it also froze onto that part of the structure's outer surface in contact with the water. When the ice sheet reached the required thickness for the test, it was found that a much greater force was required to start relative motion between the model and the adhering ice sheet than was required to maintain the relative motion after the adhesive bond between the ice and the structure was broken. For the conditions of the test, approximately 5 to 10 times as much force, depending on specific conditions, was imposed on the model structure by the ice sheet before the bond was broken than was imposed after the relative motion was begun.

The amount of the ice force imposed on the structure will, of course, be dependent on the form, dimensions and characteristics of the structure and the dimensions and characteristics of the ice. But in all cases, as the problem is understood now, a much greater force will be imposed on the structure before the adhesive bond between the structure's surface and the ice is broken than will be imposed after the bond is disrupted. That is to say, for the ramp-like surface design to be an effective means for reducing ice forces, the ice must be free to move relative to the structure. Otherwise, it might be expected that the structure would have to be built strong enough to withstand the initial forces imposed thereon as the bond between the ice and the surface of the structure is broken.

It has been found, however, that if the ice is prevented from freezing on and adhering to the structure's ramp-like surface, the structure does not need to be built strong enough to withstand the loads associated with ice-bonding. Accordingly, it has been proposed heretofore that outer surface of the structure be heated to a temperature above the melting point of the ice, or that the outer surface of the structure be made of a material having low ice-adhesion properties. Particularly, U.S. Pat. No. 3,831,385, assigned to the assignee of the present invention, discloses heat exchanger apparatus that uses exhaust gases from engines onboard the structure for heating the sloping surface of the structure to the desired temperature. This patent also discloses that electrical resistance heating may be used to maintain the temperature of the structure's exterior surface above the melting point of the ice. And U.S. Pat. No. 3,972,199, also assigned to the assignee of the present invention, discloses coating or forming the structure's sloping surface of a material that has an adhesion between ice and the structure's surface of between 0 and 100 psi.

The present invention is directed to a different way for heating the exterior surface of a production structure to a temperature above the melting point of ice.

SUMMARY OF THE INVENTION

Broadly speaking, the present invention is directed to a hull heating system for an offshore production structure that is to be used in arctic waters. In accordance with this invention, the heat from fluids produced from subaqueous wells is used in heating the outer surfaces of a production platform to a temperature above the melting point of the ice. Ice is thus prevented from freezing on and adhering to the structure's outer surfaces with the result that the overall ice forces imposed on the structure are reduced.

The production structure has at least a portion of its outer wall converging upwardly and inwardly of the underwater bottom to present a ramp-like or inclined surface to an impinging ice mass. An ice mass moving into the ramp-like surface will be raised above its natural level on the water's surface to fail in flexure as the ice moves into the structure. The production structure will be producing at least one well, and the heat associated with the production will be used to heat and maintain the ramp-like surfaces of the structure above the melting point of ice in the water.

The heat from produced fluids may also be used to heat those parts of the outer wall of the structure that may be contacted by broken sections of ice that ride-up the structure as the ice moves past the structure. For instance, the throat portion of the structure, which supports the platform decks above the water's surface, may have its outer surface heated to a temperature above the melting of the ice.

The necessary means will be provided on the structure for applying the heat from produced fluids to the inner surface of those portions of the structure's outer wall whose outer surface is to be heated to a temperature above the melting point of ice. Accordingly, a water-tight compartment, which may be a number of ballast tanks, is constructed within the structure wherein the structure's outer wall acts as a common exterior wall for both the structure and the water-tight compartment. The water-tight compartment may be connected to pumps for circulating a heat transfer fluid therethrough and through heat exchangers which are in communication with the well production.

Means for applying the heat of production to the outer surfaces of the structure may also include heating panels. The heating panels are positioned adjacent to and in heat exchange relationship with the various sections of the inner surface of the outer wall to be heated. The production will be circulated by conduit means through the heating panels so as to heat the outer surface to a temperature above the melting point of ice. Alternatively, the production may be passed through heat exchangers to heat a heat transfer fluid that is circulated through the heating panels.

Thus, the particular object of the present invention is to apply the heat from produced fluids to the inner surface of a production structure to heat at least a portion of the outer surface of the peripheral wall of the structure to a temperature above the melting point of the ice in the water adjacent the structure.

Additional objects and advantages of the invention will become apparent from a detailed reading of the specification and drawings which are incorporated herein and made a part of this specification.

DESCRIPTION OF THE PREFERRED EMBODIMENT

Figure 1:
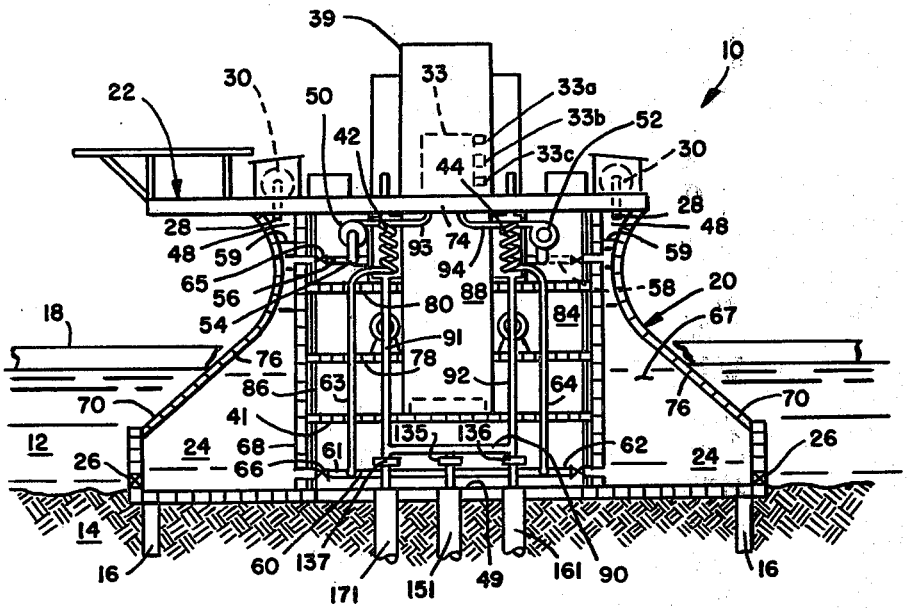
FIG. 1 is a schematic side elevational view, partly in section, illustrating a hull heating system for an offshore production structure in accordance with the present invention.

Now referring to the drawings, FIG. 1 represents an offshore production structure 10 positioned in a body of water 12 in engagement with the underwater bottom 14. The platform is designed particularly for installation in arctic waters upon which thick sheets of ice 18 as well as larger masses of ice, such as pressure ridges, will be formed. The platform has a support portion 20 which extends into the water and forms a base which supports a deck portion 22 above the surface of the water. The support portion of the platform is exposed to the water and ice forces incident to its environment, and is the part of the platform of principal interest to the present invention. Particularly, the support portion forms a peripheral wall which extends from below to above the surface of the water. At least a portion of the peripheral wall converges upwardly and inwardly of the underwater bottom to present a ramp-like surface to ice masses impinging the structure so as to elevate the ice above its natural level in an amount to cause it to fail in flexure. To this purpose, the wall may have a sloping surface in the region of potential contact with impinging ice masses.

The deck portion 22 of the platform may contain several levels of decks which serve as living quarters and working areas for the personnel on the structure. The working areas contain the necessary production equipment and may be enclosed and heated to provide a reasonably comfortable working environment and protection for men and equipment from the winter weather.

The production structure represents a platform which may be towed to the well site in a completely assembled and equipped condition. The production structure may also be of the type that has to be assembled at the site. Ballast tanks 24, see also FIG. 2, may be built into support or base portion 20 as an integral part thereof. The ballast tanks function to ballast the platform when being towed and to enable it to be lowered through the water into contact with the sea bottom. The ballast tanks provide appropriate stability when the structure is being towed, and, of course, they may be trimmed as necessary to compensate for any uneven distribution of weight within the structure. To this end, the ballast tanks are each provided with appropriate means, such as sea cocks 26, blowdown pipes 28, and compressors 30, for use in controlling the amount of ballast in the tanks.

Production platform 10 may be held on the underwater bottom by its own weight plus the weight of any ballast added to the structure. Piles 16 may be used to assist in holding the structure in place against the horizontal forces iposed thereon by impinging ice masses. The piles may also be used to support the vertical loads imposed on the structure. The hull heating system of the present invention provides a means that reduces the forces which would otherwise be imposed on the structure by an ice sheet or other larger ice mass moving against the structure. This enables a structure to be assembled that is more adaptable for use in ice-infested waters.

Figure 2:
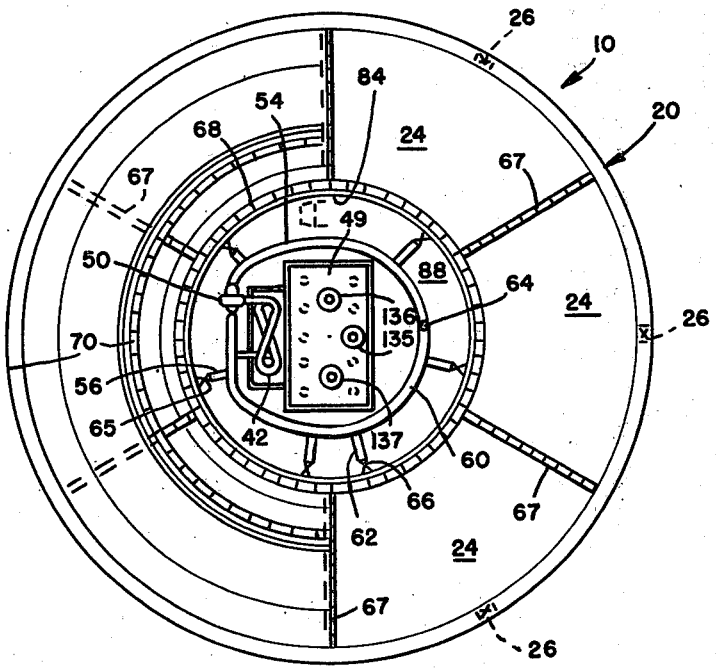
FIG. 2 is a schematic sectional plan view along line 2—2 of FIG. 1.
Figure 8:
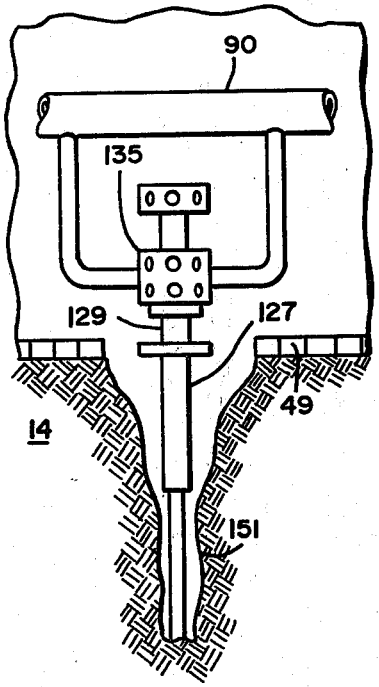
FIG. 8 is an enlarged detail, partly in section, of the wellhead at one of the producing wells.

Structure 10 is installed at the well site and equipped with the necessary equipment for carrying-on producing operations. The production equipment on the structure's deck may be enclosed, as indicated at 39, for protection from the weather. As shown in FIG. 1, the structure is positioned over a production site where a number of wellbores 151, 161, and 171 extend to wells that are to be produced on the structure. As is known in the art, appropriate casing 127, see FIG. 8, it being understood that the details of the other wellheads are the same, extends into wellbore 151 with production tubing, not illustrated, run in the casing and landed in casinghead 129. The casinghead extends into the interior of structure through bottom plate 49 where a watertight connection is made. Christmas trees 135, 136, and 137, see also FIG. 2, are connected onto the respective casingheads at the top of each well to control the flow of oil and gas from the wells. The exact number of wells to be produced from the structure may of course be more or less than three with typically more than ten wells being produced.

The produced fluids flowing from each of the Christmas trees is manifolded together at manifold 90 which is located near bottom 49 of the structure. The production from manifold 90 then flows up through flowlines or conduits 91 and 92 to respective heat exchangers 42 and 44. It is within the concept of this invention to provide any number of heat exchangers that are deemed operably desirable for heating a heat transfer fluid, as will be discussed below, to its desired temperature. And it is important to provide some redundancy in the heat exchange apparatus should some portion of the apparatus be closed down for maintenance or repair.

From the heat exchangers, the production will flow by means of flowlines or conduits 93 and 94 to an oil-water-gas separator 33 located on deck portion 22 of the structure. The separator, as is well known in the art, will separate the production into components of oil, gas, and water, which exit respectively at outlets 33*a*, 33*b*, and 33*c*. The water may be disposed of or used in the auxiliary hull heating system disclosed below. The oil and gas may be stored or transferred from the platform. It is pointed out here but it should be evident that the heat from the produced fluids, as will be shown below, is used to heat the heat transfer fluid that is circulated through the heat exchangers. The heat transfer fluid is heated to a temperature sufficient to maintain the ramp-like outer surface of the structure's support portion at a temperature above the melting point of the ice surrounding the structure.

In this embodiment of the invention, after the production platform is established in operating condition, as discussed above, the ballast tanks 24 are substantially filled with the heat transfer fluid. An atmospheric space 48 is left at the top of the tanks to function as a surge chamber and to provide for expansion of the fluid. Otherwise, the ballast tanks may be connected to auxiliary surge tanks, not shown, for this purpose.

The heat transfer fluid may be sea water to which an appropriate corrosion inhibitor has been added to protect the steel surfaces in contact with it. Desirably, an antifreeze component is added to the water to prevent it from freezing solid within the ballast tanks. The antifreeze component permits the water to remain pumpable if the water is not heated when the outer surface of the support portion of structure is reduced below the freezing point. Where fresh water is available in sufficient quantity, the ballast tanks may be purged of any salt water and filled with fresh water to which is added a corrosion inhibitor, an antifreeze component, and an algicide to make up a compounded heat transfer fluid.

Antifreeze components available for this purpose would be, for example, soluble salts, such as sodium chloride and calcium chloride, an alcohol, such as methanol, or a glycol, such as ethylene glycol, or any of several other antifreeze substances which are well known. A corrosion inhibitor is selected to be compatible and effective with the chosen antifreeze component.

Heat exchangers 42 and 44 are connected by appropriate pumps, such as 50 and 52, respectively, to a common manifold 54 for which respective conduits 56 and 58 communicate with the top portion of each individual tank 24 below level 59. The lower portion of each tank is in communication with a common manifold 60 through respective lower conduits 61 and 62. The heat exchangers 42 and 44 are connected to manifold 60 by respective conduits 63 and 64. The pumps operate to draw cooler water from the top portion of the tanks and pump it through the heat exchangers, and from there into the bottom manifold 60 from which it is directed into the bottom part of tanks 24 through lower conduits 61 and 62. Although a single pump may be used for circulating the heat transfer fluid through tanks 24, it is advisable to have at least a second pump connected in the system, either as an operating component or as standby, to insure the continued operation of the system if one of the units should fail to function. Appropriate valves placed in the upper and lower conduits, such as valve 65 in conduit 56 and valve 66 in conduit 61, provide a means for controlling the flow of heat transfer fluid through an individual tank. The valving arrangement allows independent control of the flow through adjoining tanks and also provides a means for isolating an individual tank from the heat transfer fluid circulating system as may be necessary for repair or maintenance.

As illustrated, ballast tanks 24 extend from the watertight bottom 49 of the platform up to the bottom deck 74 of the upper portion 22. The heat transfer fluid in the ballast tanks is in contact with the inner surface 76 of the peripheral wall of support portion 20 throughout substantially all of this region, this being the region of potential contact with impinging ice. The peripheral wall at least in this region is made of a material that readily transmits heat so that the heat applied to the inner surface 76 of the peripheral wall will be readily transmitted to its outer surface 70. Therefore, when the temperature of the heat transfer fluid is heated to a temperature above the melting point of the ice surrounding the platform, the temperature of the outer surface 70 of the structure will be at this temperature. The ice will thus be prevented from freezing on and adhering to outer surface 70 of the peripheral wall, permitting the ice to move across ramp-like surface 70 to be failed in flexure.

To be economical, a production structure used in arctic waters will probably have to produce at a minimum 50,000–100,000 barrels of oil per day. And typically, the wellhead production temperature would range between 125° F. and 350° F. A barrel of crude oil weighs approximately 300 lbs. and has a specific heat of about 0.5 BTU per pound per °F. This gives an energy availability of 150 BTU per barrel of oil per °F. Estimated maximum heat loads required to heat the outer surfaces of production structures of the types shown in FIGS. 1 and 5 to a temperature above the melting point of the ice would be about 12 million BTU per hour. Heat loads of this magnitude could be provided by a production of 50,000 barrels of oil per day, approximately 2,000 barrels per hour, where the temperature of the production is cooled 40° F. The same amount of heat would be available where 100,000 barrels per day, about 4,000 barrels per hour, is being produced and cooled 20° F. Similarly, a high volume of produced gas could serve as a source of heat energy for heating the exterior surfaces of the structure.

Considering the capacity of the ballast tanks and the heat available from the produced fluids, it would be expected that when the fluid in the tanks is heated enough to maintain the structure's outer surface at approximately 33° F., there will be enough heat stored in the fluid in the tanks to keep the outer surface above the freezing point of the ambient water for a period of 24 hours. Thus, this will provide a safe period for repairs or for securing the wells for maintenance purposes.

The platform shown in FIGS. 1 and 2 indicates, by way of example, six ballast tanks 24. However, it is pointed out that this is not a critical number and more or fewer tanks may be appropriate for particular platforms. The tanks illustrated are separated by radially disposed watertight walls or bulkheads 67. They are closed on their radially inwardly sides by a cylindrical wall or bulkhead 68. The radially outer wall of the tanks is the peripheral wall or shell of the support portion 20 of the platform.

For some production platforms, it will be sufficient to provide tanks for the heat exchange fluid which, although of adequate capacity, are of less volume than those indicated in the drawings. Such smaller tanks would be distributed around the inner surface 76 of the peripheral wall and be constructed to expose inner surface 76 to contact with the heat exchange fluid. These smaller tanks would be positioned on the inner surface to be in heat transfer relationship with the peripheral wall's outer surface in the area where natural ice would be expected to freeze to the wall. In this manner, the structure's outer surface in the region of potential ice contact is maintained above the melting temperature of the natural ice.

In the illustrated embodiment, the cylindrical bulkhead 68 defines working space at the core 88 of the platform. Appropriate decks, as 41, 78, and 80, are provided in the core to support men and machinery. This space will normally be heated to a comfortable working temperature, which usually will be above the temperature of the fluid in the tanks 24. Nevertheless, there is provided a layer of insulation 84 placed against the radially inner surface 86 of bulkhead 68 to reduce heat loss from these tanks.

Figure 3:
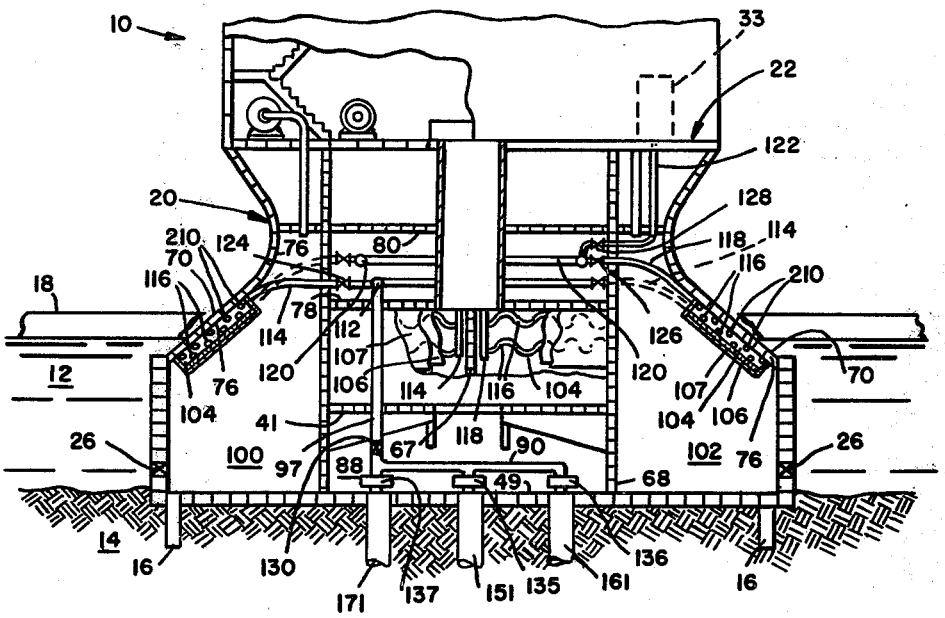
FIG. 3 is a schematic side elevational view, partly in section, illustrating a different embodiment of a hull heating system for an offshore production structure in accordance with the present invention.
Figure 4:
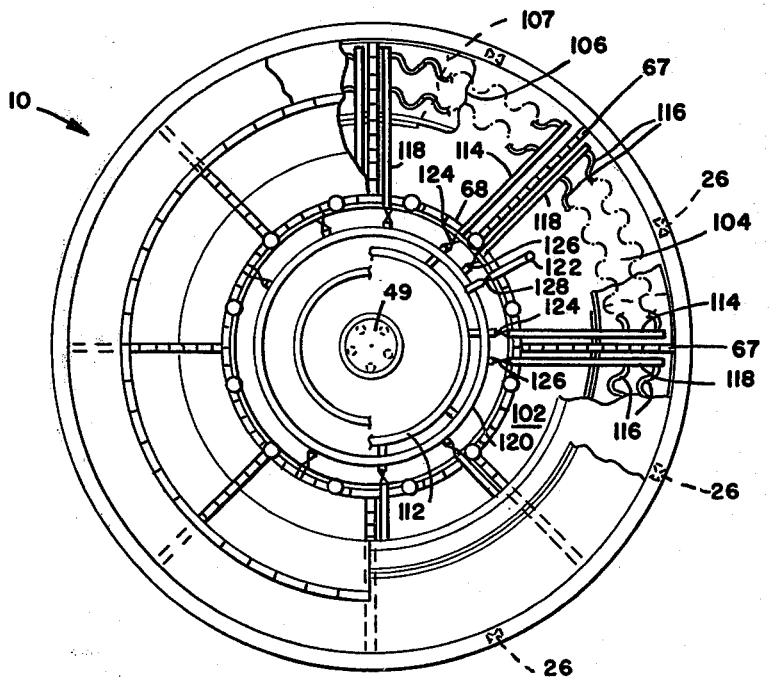
FIG. 4 is a schematic plan view, partly in section, along line 4—4 of FIG. 3, with portions broken away to expose details of the hull heating system.

FIGS. 3 and 4 represent another embodiment of the hull heating system of the present invention. The same reference numerals as used previously will be used again where applicable in relation to FIGS. 3 and 4 to designate corresponding elements.

In this arrangement, as illustrated, a watertight bulkhead 68 surrounds the central area 88 of the platform and defines the inner wall of compartments 100 and 102, which may be used as ballast tanks. However, rather than filling the compartments with a heat transfer fluid, heating panels 104 are fitted to the inner surface of the peripheral wall to be in heat transfer relationship therewith. The panels, which comprise coils of tubing, are manifolded together to receive the production flowing from Christmas trees 135, 136, and 137.

The heating panels 104 are placed against the inner surface 76 of the peripheral wall of support portion 20. The panels are located throughout the area which will be in contact with ice 18 formed in the water adjacent the structure. Preferably, the panels will extend for some distance above and below the thickness of the ice to assure that the area of the peripheral wall subject to potential ice impingement will be elevated in temperature above the melting point of the surrounding ice. To prevent heat loss, the panels of heating coils or tubing may be covered on their inward surfaces with a layer of insulating material 106. The insulating material is in turn covered by a cover 107 secured in a watertight manner to inner surface 76 to prevent any water in the compartments from contacting the heating panels and the insulation.

In operation, production flows from the Christmas trees at the respective wells, assuming more than one well is being produced, into manifold 90. And from manifold 90 it flows by flowline or conduit 97 to a second manifold 112, see also FIG. 6. From manifold 112, the production flows through respective conduits 114 to heat transfer panels 104. The production then flows through tubing 116 of the panels and into manifold 120 via respective conduits 118. From manifold 120, production flows through conduit 122 to oil-gas-water separator 33.

Appropriate valving is placed in the hull heating system to control the circulation of production to any one of the heating panel sections. This enables any panel section of the system to be taken out of the operating system for maintenance or repair. Thus, respective valves 124 are placed in conduits 114 which connect manifold 112 to the corresponding sections of heat transfer panels 104. And respective valves 126 are placed in the conduits 118 carrying the production from the heat transfer panels to manifold 120. Likewise, a valve 130 may be placed in flowline 97 to control the flow of production from manifold 90 to manifold 112. And a valve 128 may be used to control flow between manifold 120 and separator 33.

Figure 7:
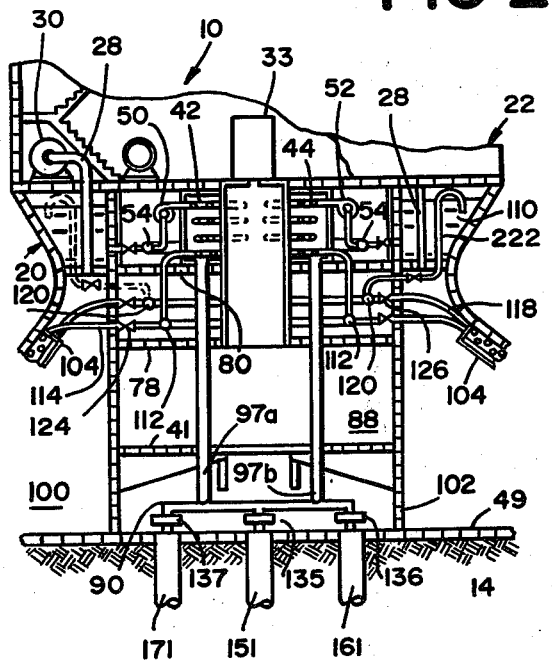
FIG. 7 is a fragmentary view illustrating an alternate embodiment of the hull heating system of FIG. 3.

As with the system of FIGS. 1 and 2, it is within the scope of the system of FIGS. 3 and 4 to use the production to heat a heat transfer fluid that is being passed through the heating panels. As shown in FIG. 7, the same numerals used previously being used again to refer to corresponding elements, production from the wells could flow through conduits 97*a* and 97*b* to heat exchangers 42 and 44, respectively. And from there via appropriate conduit means to separator 33. A heat transfer fluid of the type described heretofore would then be directed from surge tanks 108 and 110 into manifold 54. Pumps 50 and 52 would then deliver the fluid to the heat exchangers from where the fluid flows into manifold 112. Like the production, the fluid will then flow through the heating panels to manifold 120. But unlike the production, the heat transfer fluid will then flow through piping 222 back to surge tanks 108 and 110.

Appropriate valving will be provided to control the flow of the heat transfer fluid between the surge tanks and the heating panels.

Figure 5:
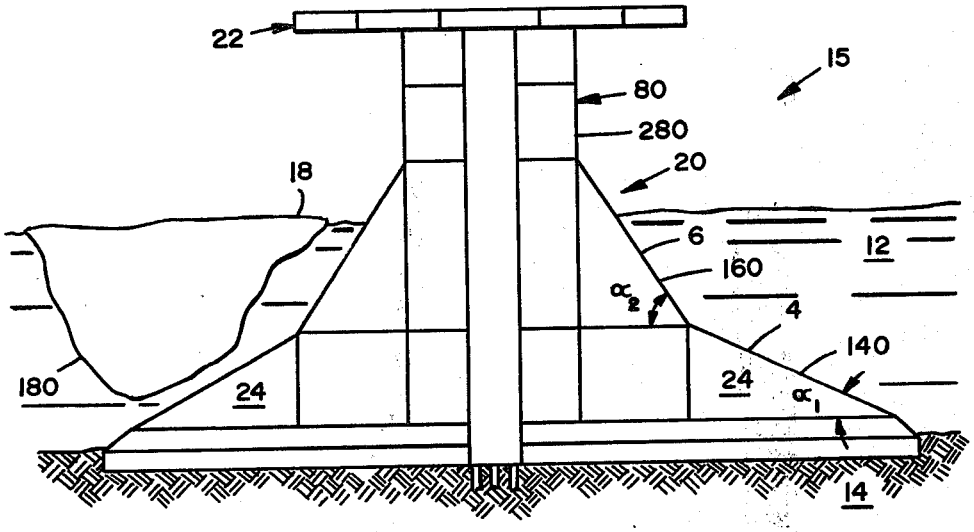
FIG. 5 is a schematic side elevational view illustrating a hull heating system in accordance with the present invention wherein the offshore production structure has a peripheral wall that includes two ramp-like exterior surfaces.

A different production structure configuration, which is the subject of copending U.S. application Ser. No. 34,085 and assigned to the assignee of the present invention, is shown in FIG. 5. That structure, referred to by numeral 15, has a support portion 20 on which a throat portion 80 is rigidly joined to extend a deck portion 22 above the surface of the body of water 12. The support portion 20 comprises an upper portion 6 coaxially positioned on top of a lower portion 4. The peripheral wall of the structure, which includes both the upper and lower portions, is inclined at an angle to the horizontal to receive ice masses, such as ice sheet 18 and pressure ridge 180, that move into contact with the structure. The angle of inclination $\alpha_2$ from the horizontal of the upper portion is greater than angle of inclination $\alpha_1$ of the lower portion. And the cross-sectional diameter of the upper portion is no greater than that at the top of the lower portion. The outer ramp-like surfaces 140 and 160 of the lower and upper portions, respectively, are designed to receive impinging ice masses to fail them in flexure.

Ballast tanks 24 are located in lower portion 4 of structure 15. Upper portion 6 contains no ballast tanks. These are the features of structure 15 that are of interest with respect to the pesent invention. Particularly, it is pointed out that the hull heating system of FIGS. 1 and 2, in which heat exchangers and heat transfer fluid means are used, may be used to heat outer surface 140 of lower portion 4. While upper portion 6, which contains no ballast tanks, may have its outer surface 160 heated by means of the system described in FIGS. 3 and 4 or the system of FIG. 7. Alternatively, these latter two systems may be used to heat the outer surfaces of both upper portion 6 and lower portion 4. It may also be desirable to use one or the other of these latter two systems to heat the outer surface 280 of throat portion 80 as the throat portion would be subject to impingment by fractured pieces of ice that ride-up the structure.

Figure 6:
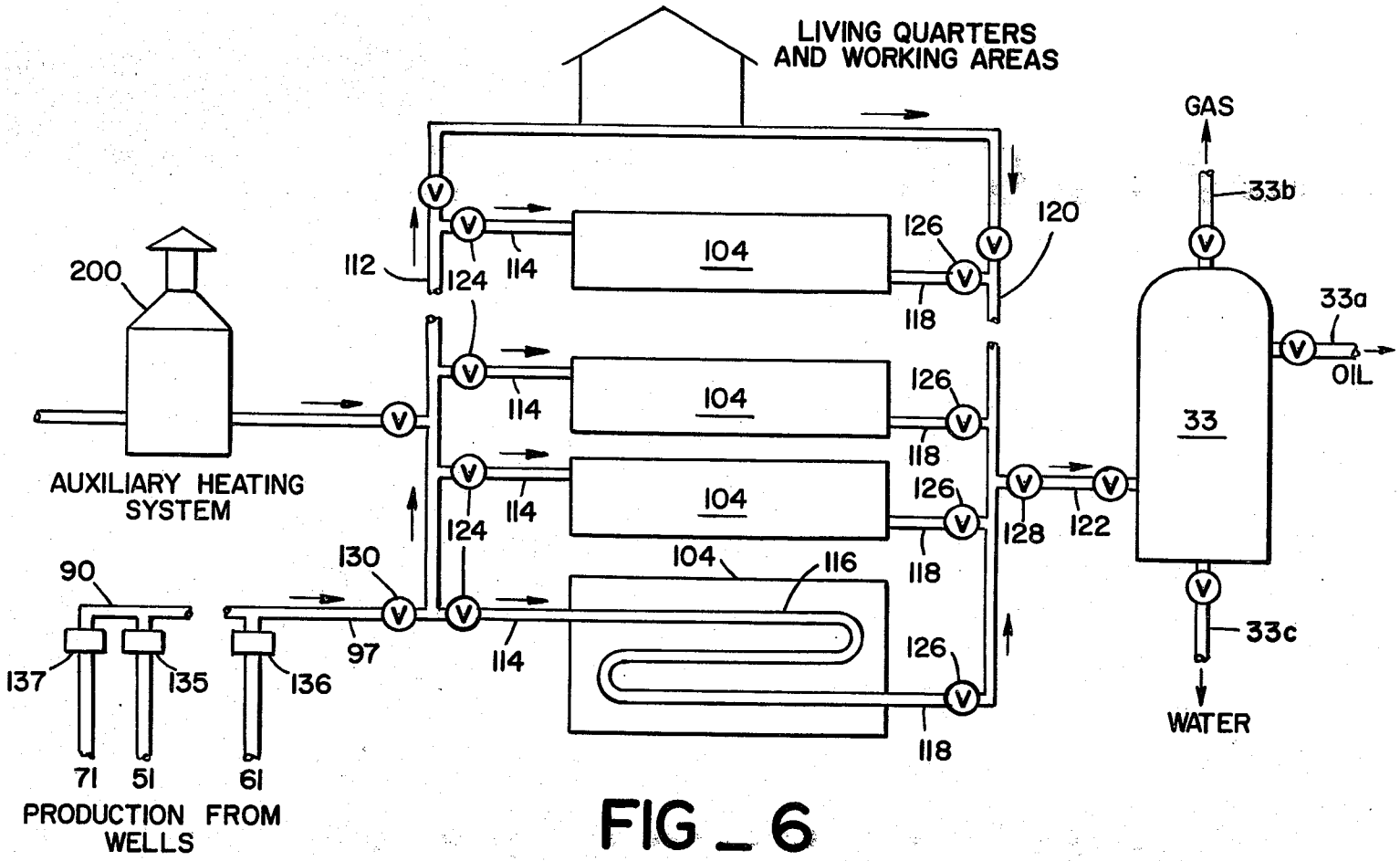
FIG. 6 is a flow diagram of the hull heating system of FIG. 3.

The available heat energy from the produced oil and gas could also be used for certain other of the structure's heating requirements. For instance, the living quarters and working areas on the structure may be heated by using the heat of production. This would be possible with either the hull heating system of FIGS. 1 and 2 or with that of FIGS. 3 and 4 or with that of FIG. 7. For the system of FIGS. 3 and 4, such an arrangement is shown in FIG. 6 wherein appropriate flowlines and valves are used to flow production to the structure's living and working areas.

The heat from the produced fluids is obviously not available until the wells are drilled and placed in production. The production heat will also not be available when the wells are shut down for repair or when the production hull heating system itself needs to be repaired. To take care of these contingencies, an auxiliary heating system needs to be provided. The auxiliary system may be a steam boiler, as shown at 200 in FIG. 6, that is designed to heat the heat transfer fluid circulated through heating panels 104, see FIG. 7, or the fluid in ballast tanks 24, see FIGS. 1 and 2. The auxiliary heat may also be provided by the use of electrical resistance heating elements 210 as shown in FIG. 3. The above-described auxiliary heating systems may also be used when the production heating system of the present invention is operating. The supply of heat to the structure's hull would then be balanced between and met by both the auxiliary and production heating systems.

It is understood that the hull heating system of the present invention will include the necessary control means to maintain the specified hull temperatures. The control means may also be used to provide the most efficient balance between heating by well production and heating by the auxiliary heating system.

Although certain specific embodiments of the invention have been described herein in detail, the invention is not to be limited to only such embodiments, but rather only by the appended claims.

What is claimed is:

1. An offshore production structure for use in a body of water that contains ice masses, comprising:

a support portion positioned in a body of water, said support portion having a peripheral wall which converges upwardly and inwardly of the underwater bottom to provide a ramp-like surface to receive ice masses moving relative to and into contact with said support portion so as to elevate the ice above its natural level an amount to cause the ice to fail in flexure adjacent said structure;

means securing said support portion to the underwater bottom;

a production well being produced from said structure;

means for applying the heat from produced fluids from said well to the inner surface of said peripheral wall to maintain the temperature of the outer surface of said peripheral wall above the melting point of ice in contact with said structure to prevent the ice from freezing on and adhering to said peripheral wall so as to assist the ice in moving over said peripheral wall, wherein said means includes at least one chamber disposed within said support portion with said peripheral wall forming the outer wall of said chamber; and means for circulating a heat transfer fluid through said chamber wherein said heat transfer fluid is heated by said produced fluids in an amount to maintain the outer surface of said peripheral wall above the melting point of the ice.

2. The offshore production structure of claim 1 wherein ballast compartments are contained within said chamber to adjoin said peripheral wall in heat transmitting relationship therewith, said heat transfer fluid being circulated through said ballast compartments.

3. The offshore production structure of claim 1 wherein heating panels are secured to the inner wall of said chamber to be in heat transmitting relationship with said peripheral wall, said heat transfer fluid being circulated through said heating panels.

4. The offshore production structure of claim 1 wherein said means for applying the heat from said produced fluids includes heating panels arranged on the inner surface of said peripheral wall to be heat-transfer relationship therewith, and means for directing said produced fluids from said well to said heating panels for circulation therethrough.

5. The offshore production structure of claim 4 further including means for conducting said produced fluids from said heating panels to an oil/gas separator.

6. The offshore production structure of claim 1 further including an auxiliary heating system for use in heating the outer surface of said peripheral wall to a temperature above the melting point of the ice surrounding said structure.

7. The offshore production structure of claim 6 further including means for using the heat from said produced fluids to heat the living quarters and working areas on said structure.

8. The offshore production structure of claim 1 further including a throat portion rigidly supported on said peripheral wall for supporting platform decks above the surface of the body of water.

9. The offshore production structure of claim 8 further including means for applying the heat from said produced fluids to the inner surface of said throat portion in an amount to maintain the temperature of the outer surface of said throat portion above the melting point of ice in contact with said structure.

10. An offshore production platform for use in a body of water in which ice is formed, comprising:

a support portion positioned in a body of water;

means securing said support portion to the underwater bottom;

a wall section on said support portion extending from below the surface to above the surface of the body of water;

said wall section formed converging upwardly and inwardly of the underwater bottom at least in the region of potential contact with ice that moves on the body of water and constructed to receive and elevate above its natural level the ice which moves on the body of water and into contact with said wall section so as to fail the ice in flexure;

a compartment enclosed within said wall section approximately in horizontal alignment with said region;

at least one production well being produced from said structure;

means for directing the production from said well to said compartment; and means for circulating the production from said well within said compartment to place the production in heat transfer relationship with the inner surface of said wall section in said region so that the outer surface of said wall section in said region is heated above the melting point of the ice formed in the body of water to prevent the ice from freezing on and adhering to said wall section.

11. The offshore production platform of claim 10 further including a cylindrical throat portion rigidly supported on said support portion for supporting a deck portion above the surface of the body of water.

12. The offshore production platform of claim 11 further including means for circulating the production from said well to the inner surface of said throat portion to be in heat transfer relationship therewith to heat the outer surface of said throat portion at least in the area of potential contact with ice above the melting point of the ice.

13. The offshore production platform of claim 10 further including an auxiliary heating system for heating the outer surface of said wall section in said region above the melting point of ice formed in the body of water.

* * * * *